United States Patent [19]

Weinerman

[11] Patent Number: 5,016,393

[45] Date of Patent: May 21, 1991

[54] DOOR CONSTRUCTION

[75] Inventor: Lee S. Weinerman, Medina, Ohio

[73] Assignee: The Eastern Company, Cleveland, Ohio

[21] Appl. No.: 516,260

[22] Filed: Apr. 30, 1990

[51] Int. Cl.[5] ..... E06B 7/16

[52] U.S. Cl. ..... 49/395; 49/495; 292/218

[58] Field of Search ..... 49/394, 395, 495, 501; 292/218, DIG. 32

[56] References Cited

U.S. PATENT DOCUMENTS

| | | | |
|---|---|---|---|
| 1,919,328 | 7/1933 | Hansen | 49/395 X |
| 2,071,236 | 2/1937 | Pierce | 49/495 X |
| 2,505,945 | 5/1950 | Dath | 292/218 X |
| 2,558,824 | 7/1951 | Dath | 292/218 X |
| 2,560,308 | 7/1951 | Spraragen | 49/495 X |
| 3,055,969 | 9/1962 | Schaller | 49/395 X |
| 3,132,893 | 5/1964 | Herr et al. | 49/394 X |
| 3,518,792 | 7/1970 | Williamson et al. | 49/488 |
| 3,596,403 | 8/1971 | Carr | 49/395 X |
| 3,691,688 | 9/1972 | Kaiserwerth | 49/394 |
| 3,717,955 | 2/1973 | Urbanick | 49/488 |
| 3,756,671 | 9/1973 | White | 308/15 |
| 3,841,516 | 10/1974 | März | 49/394 X |
| 3,886,686 | 6/1975 | Urbanick | 49/488 |
| 3,950,894 | 4/1976 | DiMaio | 49/394 X |
| 4,014,138 | 3/1977 | White | 49/367 |
| 4,068,409 | 1/1978 | White | 49/367 |
| 4,498,264 | 2/1985 | McCafferty et al. | 52/281 |
| 4,953,324 | 9/1990 | Herrmann | 49/258 |

FOREIGN PATENT DOCUMENTS

| | | | |
|---|---|---|---|
| 502565 | 5/1954 | Canada | 49/495 |
| 2517108 | 10/1975 | Fed. Rep. of Germany | 49/394 |
| 2320414 | 8/1975 | France | 49/501 |
| 448794 | 4/1968 | Switzerland | 49/394 |
| 1249311 | 10/1971 | United Kingdom | 292/218 |

*Primary Examiner*—Rodney M. Lindsey
*Assistant Examiner*—Jerry Redman
*Attorney, Agent, or Firm*—David A. Burge

[57] ABSTRACT

A door construction system for fabricating doors that typically are of rectangular shape, hinged along left or right sides, and used to selectively close access openings of cargo containers, trailers, trucks and the like. Each control member has an associated structural member that comprises a part of the door's core and parallels the associated axis. Each structural member has opposed side portions that are sandwiched between portions of the inner and outer skins, and central portions that project through the associated outer skin opening to nestingly receive portions of the elongate control member to assist in mounting the control member on the door for pivotal movement, to add strength, and to enhance anti-rack capabilities of the door and its associated door control system.

24 Claims, 3 Drawing Sheets

DOOR CONSTRUCTION

CROSS-REFERENCE TO RELATED APPLICATIONS AND TO RELEVANT PATENTS

Reference is made to the following two related, concurrently-filed design applications (referred to hereinafter as the "Companion Design Cases"), the disclosures of which are incorporated herein by reference:

ELONGATE DECORATIVE AND STRUCTURAL COMPONENT FOR USE WITH DOORS FORMED FROM SPACED PANELS, Ser. No. 07-516,211 filed (concurrently herewith) by Lee S. Weinerman; and, ELONGATE DECORATIVE AND STRUCTURAL COMPONENT FOR USE WITH DOORS FORMED FROM SPACED PANELS, Ser. No. 87-516,218 filed (concurrently herewith) by Lee S. Weinerman.

Reference also is made to the following patents that relate to door control mechanisms for use with pivoted doors and associated door frame structures of the type that typically define access openings in cargo containers, trailers, trucks and the like, with pivotal movements of the doors selectively serving to "open" and "close" the access openings (with these patents being referred to collectively hereinafter as the "Door Control Patents"), the disclosures of which are incorporated herein by reference, namely U.S. Pat. Nos. 4,601,501, 3,737,183, 3,695,661, 3,572,794, 3,484,127 and 3,099,473 issued to John Pastva; and U.S. Pat. No. 4,127,291 issued to Albert Pelcin.

BACKGROUND OF THE INVENTION

1. Field of the Invention

The present invention relates to a system for forming skin/core sandwich-type doors of the general type that each employ a pair of spaced inner and outer panels or "skins" that sandwich core materials. Aspects of the invention are numerous and, without limitation, relate 1) to methods for assembling skin/core sandwich-type doors having improved features, 2) to the resulting novel and improved door structures, and 3) to features of elongate structural members that are utilized to form portions of the cores of such doors while simultaneously serving to aid in pivotally mounting elongate door control members on the doors.

2. Prior Art

Door control mechanisms for use with pivoted doors and their associated surrounding frame structures, as embodied in trucks, trailers, cargo containers and the like are well known, as is exemplified by the several referenced Door Control Patents.

Door control mechanisms that include anti-rack features likewise are well known. The need for such features, and the manner in which anti-rack features typically are incorporated into present-day door control mechanisms is described and illustrated in the several referenced Door Control Patents.

Of the referenced Door Control Patents, particular attention is directed to the anti-rack door control system disclosures of U.S. Pat. Nos. 3,737,183 and 3,695,661 (referred to hereinafter as the "Cam and Keeper Door Control Patents"). Several of the door control components that are described and illustrated in the Cam and Keeper Door Control Patents are utilized in the "best mode" known to the inventor for carrying out the preferred practice of the present invention.

It is known to fabricate latchable doors of rectangular shape that are hinged along their left or right sides, and that are used to selectively open and close access openings of cargo containers, trailers, trucks and the like. It is known for such doors each to include an inner panel or "inner skin," an outer panel or "outer skin," and a core of material that is sandwiched between and connected to the inner and outer skins. Doors of this kind often are referred to by those skilled in the art as utilizing "skin/core sandwich-type" construction.

Typically, one or more of the inner and outer skins utilized in skin/core sandwich-type door constructions of prior proposals (especially the outer skin) is/are comprised of one-piece sheets of metal such as aluminum, stainless steel, steel treated to resist corrosion, or the like—with care being taken to assure that such skins (especially the outer skin) is/are of sufficient width to extend in an uninterrupted manner for the full distance between left and right sides of the associated door. One-piece skin construction has been preferred to eliminate unnecessary joints, and to maximize strength, dimensional stability and reliability during service. As will become apparent from the description of the present invention that follows, the present invention "flies in the face" of this conventional practice, and in doing so, provides features of enhanced strength, enhanced dimensional stability and enhanced reliability during service.

Despite the active nature of development work that has been underway for many years in efforts to provide improvements in skin/core sandwich-type door construction systems, a need has continued to exist for an improved door construction system that provides skin/core sandwich-type doors that are strong, dimensionally stable and reliable—and that resist "racking" as by providing enhanced strength especially in the regions where antirack door control system components are positioned and mounted. Inadequately addressed by prior proposals is a long-standing need for providing a door structures that incorporate anti-rack door control system features into the actual make-up of skin/core sandwich-type door structures in novel and improved ways that also serve to provide other enhancements in doors and door control systems.

THE REFERENCED COMPANION DESIGN CASES

The Companion Design Cases that are filed concurrently herewith create to appearance features of elongate extrusion-formed members that may be used in carrying out the most preferred practice of the invention of the present application.

It should be understood, however, that a line of demarcation exists among the related concurrently-filed design and utility cases. Many configurations of extrusion-formed members can be substituted for the configurations that are addressed by the Companion Design Cases in order to carry out the spirit and practice of the invention of the present utility case. Moreover, while the referenced Companion Design Cases relate to elongate members that have cross sections which are uniform along their lengths, the spirit and practice of the invention of the present utility case can be carried out as by utilizing members that are of non-uniform cross sections along their lengths, and/or by utilizing a plurality of components, some of which have differing cross sections.

Thus, appearance considerations can and do enter significantly into determining the cross-sectional configurations that comprise articles of manufacture that embody subject matter of the two Companion Design Cases.

SUMMARY OF THE INVENTION

The present invention addresses the foregoing and other needs by providing doors of novel and improved construction, by providing elongate door construction elements of novel and improved form for use in constructing doors of the type that have spaced "skin" panels, and by providing novel and improved methods of forming skin/core sandwich-type doors having inner and outer panels or "skins" that are held in spaced relationship, at least in part, by utilizing the novel and improved, elongate door construction elements.

The present invention relates to a highly advantageous system for constructing doors of the general type that each employ a pair of spaced inner and outer panels or "skins" that sandwich a "core," with selected portions of the cores of such doors including elongate structural members that are typically of substantially uniform cross section along their lengths, with the structural members offering advantages such as facilitating door fabrication and assembly, strengthening the resulting door structures, and cooperating with components of door control systems that are utilized with the door structures, whereby fabrication costs are kept at a minimum while providing high quality doors with enhanced features.

The system of the present invention is particularly well suited for use with anti-rack door control systems of the general type that are described in the referenced Door Control Patents, especially the Cam and Keeper Door Control Patents, namely U.S. Pat. Nos. 3,737,183 and 3,695,661. Aspects of the invention include not only methods for assembling skin/core sandwich-type doors having improved features, but also include the resulting novel and improved door structures, and features of the elongate structural members that are utilized to form portions of the core structures of doors while simultaneously serving to aid in pivotally mounting elongate door control members on the doors.

In preferred practice, the present invention relates to door structures that typically are utilized on cargo containers, trailers and trucks, large industrial cabinets and the like that each typically are provided along one side with a hinged connection to a door frame (or other structure that extends about an access opening that is "closed" by the door when the door is in its "closed" position), with each door typically pivotally mounting at least one elongate, rod-like or tubular door control member that has opposed ends located near top and bottom ends of the door, and with each of the opposed ends of the control member carrying a cam member that is configured to interengage an associated cam receiving keeper member that is connected to a portion or the door frame (or other structure that extends about the associated access opening) so as to releasably retain the door in its closed position.

In preferred practice, the present invention relates to skin/core sandwich-type door structures that utilize novel and improved elongate structural members that not only comprise part of the sandwiched cores of the door structures but also project through elongate openings that are formed in the outer skins of the door structures to provide concave formations that serve to receive and nest—so as to assist in pivotally mounting and in strengthening—elongate door control members that preferably are utilized in anti-rack door control systems of the general type that form the subjects matter of the referenced Door Control System Patents.

In preferred practice, a door construction system is provided for fabricating securely latchable doors, typically of rectangular shape that are hinged along left or right edges and are used to selectively close access openings of cargo containers, trailers, trucks and the like. Each door typically is formed as "sandwich" of a core that extends between inner and outer panels or "skins." Each door typically is provided with an "anti-rack" door control system that includes at least one elongate tubular control member, each of which extends along a separate, typically vertical axis that parallels and closely overlies an elongate opening formed through the door's outer skin. Each of the control members has a pair of cam members secured to its opposite ends for pivotal movement with the control member about the associated vertical axis for pivoting the cam members into and out of latching interengagement with keeper members that are connected to upper and lower door framing components at locations above and below the door's associated access opening to selectively retain the door in and release the door from its closed, latched position and to minimize "racking." Each control member has an associated structural member that comprises a part of the door's core and parallels the associated axis. Each structural member has opposed side portions that are sandwiched between portions of the inner and outer skins, and central portions that project through the associated outer skin opening to nestingly receive portions of the elongate control member to assist in mounting the control member on the door for pivotal movement, to add strength, and to enhance anti-rack capabilities of the door and its associated door control system.

BRIEF DESCRIPTION OF THE DRAWINGS

These and other features, and a fuller understanding of the invention may be had by referring to the description and claims that follow, taken in conjunction with the accompanying drawings, wherein:

DESCRIPTION OF THE PREFERRED EMBODIMENT

Figure 1:
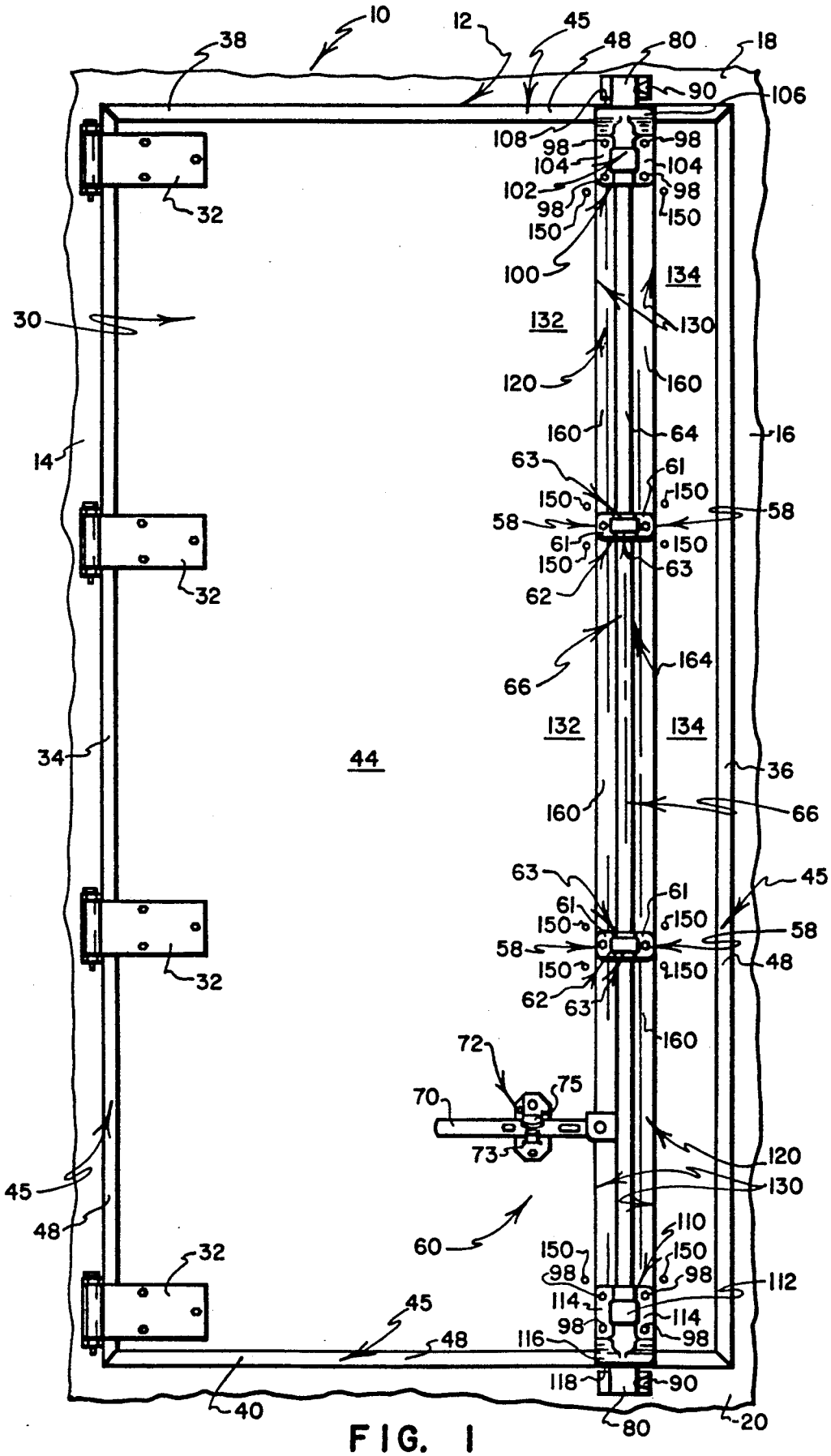
FIG. 1 is a front elevational view of a left-hinged door, and of portions of a door frame and structure that surrounds and defines an access opening that is selectively opened and closed as by pivotally moving the door about an imaginary, vertically-extending axis (not shown) that is defined by the left-side-mounted hinges that are shown connecting the door to left-side door frame portions, with an anti-rack door control system for selectively releasably retaining the door in its closed position also being shown.

Referring to FIG. 1, a wall of a cargo compartment such as a truck body, a trailer body, a cargo container or the like is indicated generally by the numeral 10. The wall 10 has a generally rectangular access opening formed through it, with the opening being indicated generally by the numeral 12. Defining the opening 12 are horizontally spaced left and right frame members 14, 16 which connect with vertically spaced top and bottom frame members 18, 20.

A door that embodies the preferred practice of the present invention is indicated generally by the numeral 30. The door 30 is connected by hinges 32 to the left frame member 14. The door 30 is of generally rectangular shape, having horizontally spaced left and right side or edge regions 34, 36, and vertically spaced top and bottom side or edge regions 38, 40.

Figure 2:
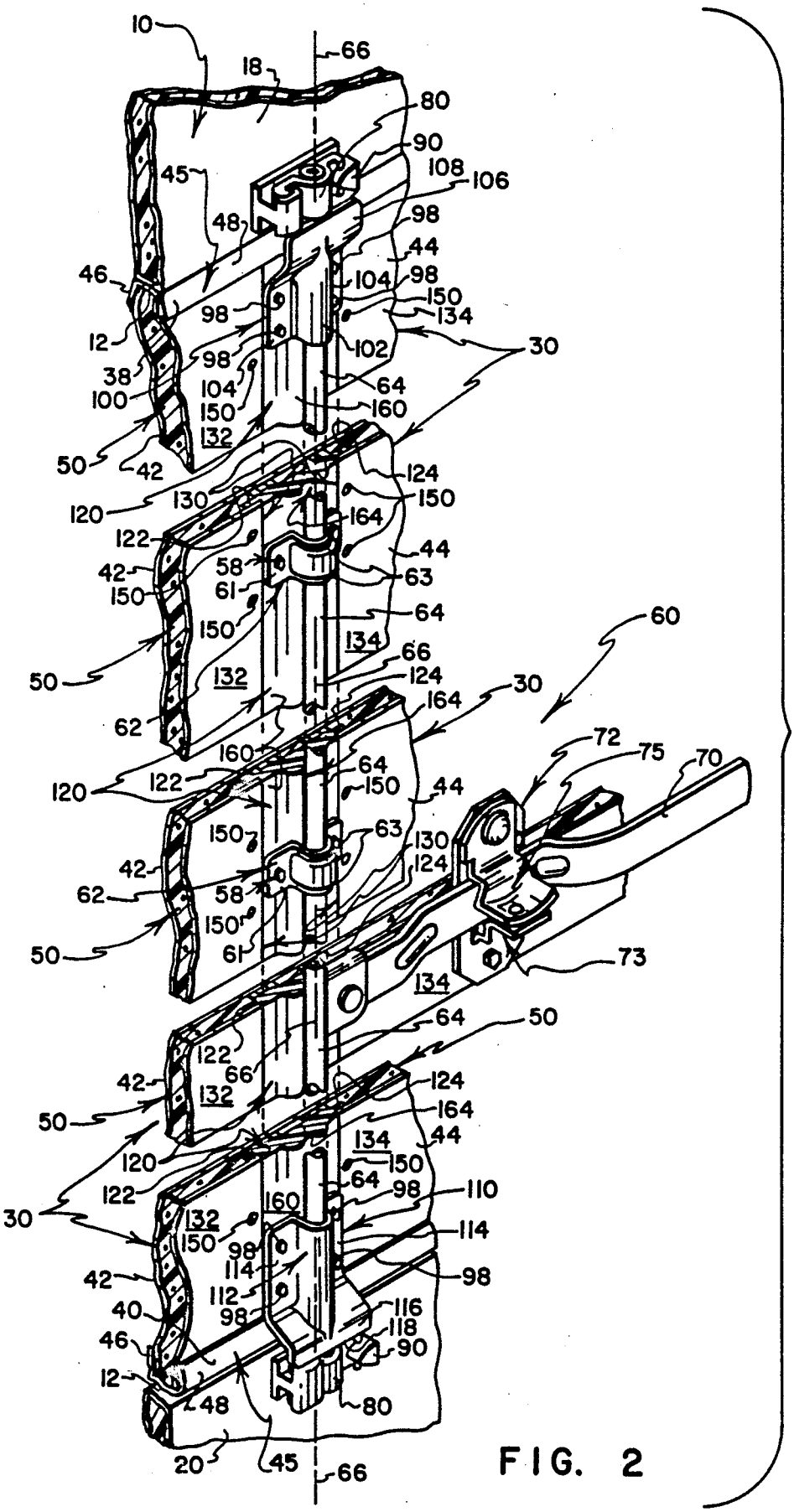
FIG. 2 is an exploded perspective view, on an enlarged scale, of portions of a door, door frame and door control system, with these components being identical to those that are depicted in FIG. 1 except that the components are arranged so as to provide a right-hinged door (i.e., the components and portions thereof that are depicted in FIG. 2 constitute mirror images of corresponding components and portions thereof that are depicted in FIG. 1)

While FIG. 2 shows a door that is set up so as to be right-hinged (which is in contrast to the door 30 that is depicted in FIG. 1 which is set up so as to be left-hinged), the door of FIG. 2 and its associated components comprise simple mirror images of the corresponding door 30 of FIG. 1 and its associated components. Thus, for purposes of simplicity (and to make quite clear that the system of the present invention has equal application to not only left-hinged and right-hinged doors, but also to closures and hinge mounting arrangements that can take a wide variety of forms), the same reference numerals that are used in referring to the door of FIG. 1 and its associated components are utilized in referring to the door of FIG. 2 and its associated components.

Figure 4:
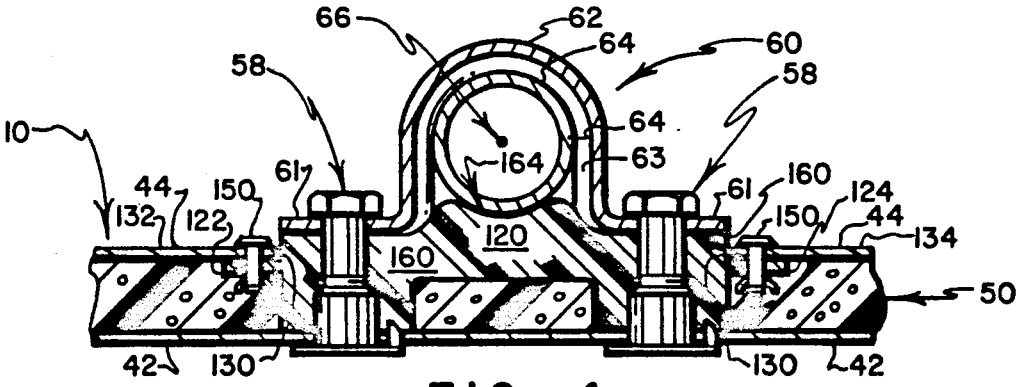
FIG. 4 is a sectional view as seen from a plane indicated by a line 4—4 in FIG. 3, and, in particular, depicting one preferred embodiment of an extrusion that is employed in the fabrication of a door that incorporates features of the present invention; and, FIG. 5 is a sectional view similar to FIG. 3 but depicting an alternate cross-sectional embodiment of an extrusion, and showing how the alternate extrusion embodiment is utilized in the fabrication of a door that incorporates features of the present invention.

Referring to FIGS. 2 and 4, the door 30 has an inner panel or inner "skin" 42, and an outer panel or outer "skin" 44 that sandwich core material that is referred to generally by the numeral 50. The skins 42, 44 prefer ably are substantially flat and extend in parallel planes, spaced apart by the core material 50 which is of substantially uniform thickness.

In preferred practice, the side or edge regions 34, 36, 38, 40 are defined by a rectangular array of four structural members 45 that each are of [-shaped channel cross section. Referring to FIG. 2, the members 45 surround and enclose perimetrically extending portions of the inner and outer skins 42, 44. The [-shaped channel members 45 have inner leg members 46 that overlie perimetrically extending portions of the inner skin 42, and outer leg members 48 that overlie perimetrically extending portions of the outer skin 44.

Referring to FIGS. 1 and 2, a door control mechanism 60 is mounted on the exterior of the outer skin 44. The door control mechanism 60 has a plurality of strap-like bearing members 62 that have opposed end regions 61. Referring to FIG. 4, conventional fasteners that are indicated generally by the numeral 58, extend through aligned holes that are formed in the end regions 61 and through the various elements that comprise the structure of the door 30 to mount the strap-like bearing members 62 on the door 30.

The strap-like bearing members 62 preferably are formed as metal stampings that each have a pair of spaced U-shaped central portions 63 (best seen in FIG. 3) that closely overlie portions of an elongate, tubular, door control member 64 (so as to partially "surround" portions of the door control member 64 in a "slip fit" that serves to assist in "journaling" or mounting the door control member 64 on the door 30 for pivotal movement relative to the door 30 about an imaginary vertical axis that is indicated by the numeral 66).

The tubular door control member 64 extends coaxially about the axis 66. The axis 66 is spaced from but extends substantially vertical, in substantially parallel relationship to the exterior surface of the outer skin 44.

A door control handle 70 of conventional configuration connects with the door control member 64 for pivotally moving the door control member 64 about the axis 66 between latched and unlatched positions. It is the purpose of the handle 70 to bring engaged cam and keeper members 80, 90 into and out of latching engagement—which can only be effected when the door 30 is in a "substantially closed" position (i.e., a position wherein the cam and keeper members 80, 90 already are in engagement such that they are properly positioned for movement either into or out of latching interengagement).

Movement of the cam and keeper members 80, 90 out of latching interengagement is effected by pivoting the handle 70 and the door control member 64 about the axis 66 as by beginning with the handle 70 extending in closely spaced, substantially parallel relationship with the outer skin 44 of the door, as is depicted in FIGS. 1 and 2. The required movement of the handle 70 is one of pivoting the distal end region of the handle 70 away from the skin 44 (i.e., toward a position wherein the handle 70 projects at an angle away from the plane of the outer skin 44 of the door 30) to a sufficient degree that the interengageable cam and keeper members 80, 90 are free to disengage when the door 30 is pivoted open), whereupon the door 30 can be pivoted about the axis of the hinges 32 to an open position The position that is occupied by the handle 70 when the door 30 can be pivoted about the axis of the hinges 32 so as to bring the cam and keeper members 80, 90 freely into and out of engagement will be referred to herein as the "open/close" position of the handle 70.

Movement of the cam and keeper members 80, 90 into latching interengagement so as to "latch" the door 30 closed is effected by reversing these steps, i.e., as by positioning the handle 70 in its "open/close" position, by pivoting the door 30 about the axis of the hinges 32 to a substantially closed position wherein the cam and keeper members 80, 90 are brought freely into engagement, and by pivoting the handle 70 to a position extending closely alongside portions of the door 30 substantially paralleling the outer skin 44—a position that will be referred to herein as the "latching" position of the handle 70.

A retainer assembly 72 of conventional padlockable configuration is mounted on the outer skin 44 of the door 30 for releasably retaining the handle 70 in its "latching" position. The handle 70 can be secured as by being "padlocked" in its "latching" position by installing a conventional padlock (not shown) with its U-shaped shank extending through aligned holes that are formed in relatively movable portions 73, 75 of the retainer assembly 72 that serve to receive and confine the handle 70 to its "latching" position.

Referring to FIGS. 1 and 2, cam members 80 are connected to opposite end regions of the door control member 64. The cam members 80 are configured to be received within and cooperatively engaged by mating keeper members 90. The keeper members 90 are carried on the top and bottom frame members 18, 20, and cooperate with the cam members 80 to releasably retain the door 30 in its closed, latched position—by which arrangement, access through the opening 12 is controlled.

The manner in which the cam and keeper members 80, 90 engage, disengage and interengage to selectively, releasably, latchingly retain the door 30 in its latched, closed position does not form a part of the present invention, but is explained in detail in the referenced Cam and Keeper Door Control Patents (the disclosures of which are incorporated herein by reference)—whereby there is no need to go into detail here about the manner in which the cam and keeper members 80, 90 interengage. Moreover, inasmuch a wide variety of commercially available cam and keeper members can be substituted for the members 80, 90 without departing from the spirit and practice of the present invention, details of the configuration and operation of the members 80, 90 do not need to be included here in order those who are skilled in the art to be able to carry out the preferred practice of the present invention.

In preferred practice, a pair of upper and lower bearing members or brackets 100, 110 are provided near the upper and lower edge regions 38, 40 of the door 30 at locations that are within the vicinities of where cam and keeper members such as the members 80, 90 interact to "latch" the door 30. In the most preferred practice of the invention, the upper and lower bearing members or brackets 100, 110 perform a plurality of functions in that they assist in journaling upper and lower end regions of the elongate tubular door control member 64; and, the brackets 100, 110 help to prevent side-to-side and forward-rearward movements of the door control member 64 relative to the door 30 (whereby, in cooperation with the strap-like bearing members 62, the upper and lower bearing members 100, 110 cooperate to hold the door control member 64 straight and true, extending without deviation along the axis 66).

The brackets 100, 110 preferably are formed as steel stampings that define U-shaped central channel formations 102, 112, respectively. The channel formations 102, 112 serve to partially surround end regions of the door control member 64. The brackets 100, 110 also have mounting flange portions 104, 114, respectively, that extend along opposite sides of their associated central channel formations 102, 112, respectively. Conventional fasteners 98 (preferably like the fasteners 58 that are depicted in FIG. 4) extend through holes formed in the flange portions 104, 114 and through adjacent portions of the door 30 (preferably in the manner illustrated in FIG. 4 in conjunction with the fasteners 58) to mount the brackets 100, 110 on the door 30.

The portions 102, 104 of the upper bracket 100, and the portions 112, 114 of the lower bracket 110 merge with flat portions 106, 116 of the brackets 100, 110, respectively. The flat portions 106, 116 provide horizontally extending, upwardly and downwardly facing surfaces 108, 118, respectively that serve to extend closely beneath and closely above the upper and lower pairs of interengaged cam and keeper members 80, 90 when the door 30 is closed and latched—whereby the surfaces 108, 118 cooperate with the interengaged pairs of cam and keeper members 80, 90 to assist in preventing racking movements of the door 30 and the wall 10.

Because the above-mentioned components that comprise major elements of the door control system 60 all are described in detail in the referenced Cam and Keeper Door Control Patents (the disclosures of which are incorporated herein by reference), and because, without departing from the spirit and practice of the present invention the door control system components described above all can be replaced by differently configured but basically similarly functioning components (that are commercially available from a variety of sources), it is neither necessary nor desirable to continue with a more detailed description of the aforementioned components of the door control system 60. Instead, the description presented in the paragraphs that follow will be directed toward features of, the use of, and the fabrication of door panels that contain elongate structural members such as the one that is designated generally by the numeral 120 in FIGS. 1–4—an elongate structural member that extends partially within and partially without the cavity that is defined by the panels or skins 42, 44 that define the "sandwich" structure of the door 30.

Referring to FIGS. 1–4, the structural member 120 extends closely alongside the axis 66, with side portions 122, 124 thereof forming a part of the core 50 of the door 10, and with a central portion protruding through an elongate opening 130 that is formed through the outer skin 44 to provide concave surface portions 164 that engage, support and cooperate with the brackets 62, 100 and 110 to pivotally mount the door control member 64 on the door 30 for movement about the axis 66, as will be discussed in greater detail.

Figure 3:
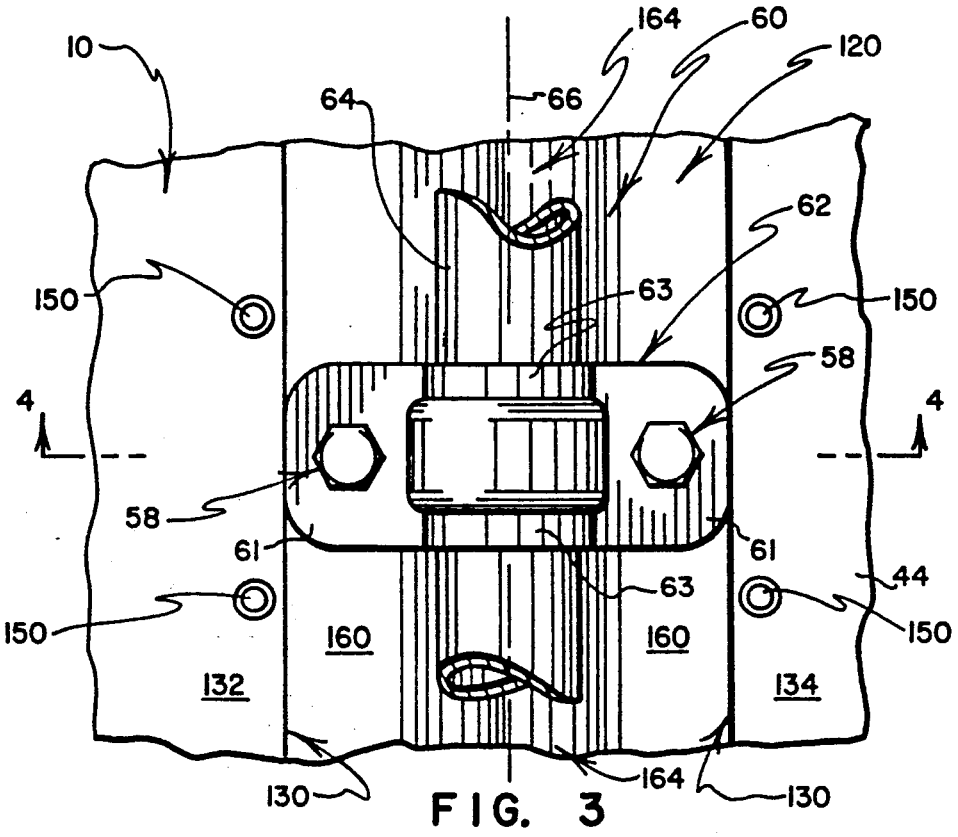
FIG. 3 is a view on an enlarged scale of a portion of the front elevational view of FIG. 1.

Referring to FIG. 1, an elongate, vertically extending opening, which is indicated generally by the numeral 130, is provided in the outer skin 44 of the door 30. The opening 130 is defined by spaced, vertically extending portions 132, 134 of the outer skin 44. Referring to FIG. 4, it will be seen that the structural member 120 has opposed side portions 122, 124 that underlie and supportingly engage the side portions 132, 134. Referring to FIGS. 1–3 in conjunction with FIG. 4, it will be seen that rivets 150 are provided to extend (at spaced intervals along the length of the structural member 120) through aligned holes that are formed 1) in the skin portion 132 and the side portion 122, and 2) in the skin portion 134 and the side portion 124, by which arrangement the structural member 120 has its side portions 122, 124 rigidly connected to the vertically extending portions 132, 134 of the outer skin 44 of the door 30.

Figure 5:
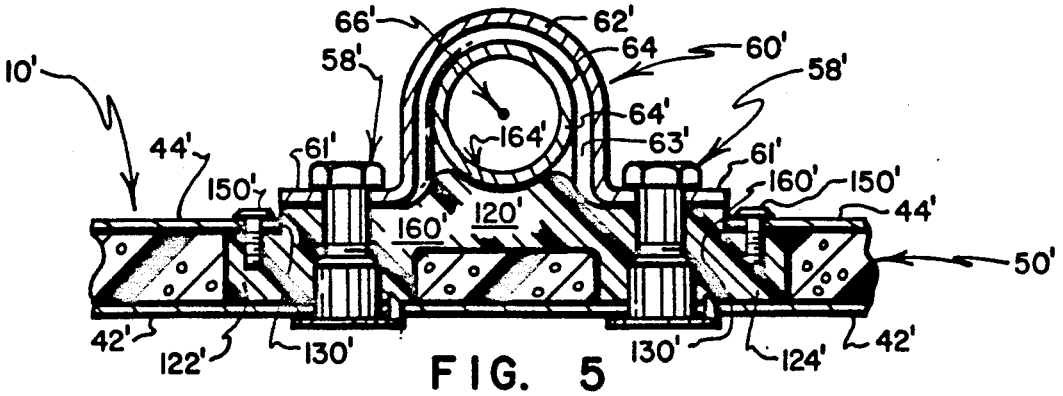

In point of fact, what is depicted in FIGS. 4 and 5 are two similar but alternate forms of structural members 120, 120' that have slightly different cross sectional configurations and that are substitutable one for the other. As regards FIGS. 4 and 5, all corresponding components in FIGS. 4 and 5 are indicated by identical numerals, but with the numerals that are utilized in FIG. 5 each being accompanied by a prime mark. By this arrangement of corresponding numerals, similarities of structure and function are made more readily apparent, and yet attention is drawn to the fact that the door construction features that are depicted in FIGS. 4 and 5 are not in all respects identical.

Among differences that exist between the members 120, 120' that are depicted in FIGS. 4 and 5 are the relative thicknesses of the side portions 122, 124 and 122', 124'. In the embodiment of FIG. 4, the side portions 122, 124 are relatively thin so as to enable conventional blind rivets 150 to expand in a space that exists between the side portions 122, 124 and the inner skin 42. In the embodiment of FIG. 5, the side portions 122', 124' are relatively thick (i.e., extending the full width between the inner and outer skins 42', 44') so as to work well with rivets 150' that lock into engagement with material that surrounds the holes into which the rivets 150' are installed as by frictionally engaging or expanding within such holes as are formed in the side portions 122' 124' to receive the rivets 150'. Alternatively, holes (not shown) for the rivets 150' can be drilled the full distance through the side portions 122', 124' and through the skins 42', 44' so that enlarged head formations (not shown) of the rivets are formed adjacent the exposed surfaces of the skins 42', 44'.

From the foregoing description, and from the cross-sectional views provided by FIGS. 4 and 5 of the drawings, it will be seen that the doors 10, 10' are of the skin/core sandwich-type of construction, but that, in contrast to conventional skin/core sandwich-types of door construction proposals, the present invention utilizes a lengthy slot or opening, such as the slots or openings 130, 130' that are formed through outer skin members 44, 44', and that portions of the cores 50, 50' of the doors 10, 10' are occupied by side portions 122, 124 and 122', 124' of elongate structural members 120, 120'; moreover, the doors 10, 10' have central portions 160, 160' that extend through the openings 130, 130'. This unusual and unconventional arrangement gives rise to a number of advantages—especially in efforts to provide strong, dimensionally stable, highly reliable door structures.

A feature of the structural members 120, 120' is that their central portions 160, 160' define elongate, concave recesses 164, 164' that serve to receive, support and assist in journaling portions of the door control members 64, 64'. By this arrangement, the structural members 120, 120' not only serve to strengthen the skin/core sandwich portions of the doors 10, 10', but also serve to provide strengthening effect in areas that often benefit from such strengthening, namely in areas extending along the door control members 64, 64'.

As will also be apparent from the foregoing description taken together with the illustrations that comprise the drawings, the concave recesses 164, 164' that open toward and receive (in a manner that provides extensive, elongate bearing and support surfaces) and engage the door control members 64, 64', aid and assist not only the door control members 64, 64' (which often are stressed by loadings and racking movements of the cargo containers on which the doors 10, 10' are mounted) but in the mounting of such components as strap-like bearing members and end brackets (e.g., the components 62, 62', 100, 110) that cooperate with the structural members 164, 164' to journal and mount the door control members 64, 64'.

Still another aspect that will be apparent from the foregoing description and the accompanying drawings is that features of the invention reside in the relatively simple and straightforward manner in which structurally strong, dimensionally stable door panels can be formed that include, as structural elements thereof, elongate members that form a part of the core of the skin/core sandwich-type construction while also extending through an outer surface of one of the skins to provide formations that both support door control system components and that cooperate with door control system components to provide door structures that are improved and offer features that are not present in prior proposals.

In fabricating doors of the type described and illustrated herein, core materials 50 and skin materials 42, 44 of a variety of types may be utilized to provide desired characteristics for particular applications. While aluminum, stainless steel, or corrosion-resistant steel sheets are among the more conventional candidates for use in forming the skins 42, 44, as will be apparent to those skilled in the art, more exotic materials may be utilized, or materials may be combined, to provide such characteristics as may be required by a particular application—with an advantage of the present door construction system residing in the versatility that it offers in working with a wide variety of materials to meet specific needs Likewise, great flexibility is provided in determining the content and make-up of the core 50. Structural or reinforcing members (not shown) may be inserted into the core are to provide secure mountings for such hardware as hinges, latches, locks and the like; and, to the extent that essentially "open" space remains in the core area, it can be filled with foam, honeycomb or other material that is selected because it is light in weight and/or because it insulates against heat transfer and/or due to its sound absorbing characteristics, etc. If foam material is to be utilized, it can be "foamed in situ" or pre-foamed and pre-cut for precise space-filling assembly.

Although the invention has been described in its preferred form with a certain degree of particularity, it is understood that the present disclosure of the preferred form is only by way of example, and that numerous changes in the details of construction and the combination and arrangements of parts and the like may be resorted to without departing from the spirit and scope of the invention as hereinafter claimed. While "orientation terms" such as "upwardly," "downwardly," "rightwardly," "leftwardly," "forwardly," "rearwardly" and the like have been utilized in describing the invention, these terms should not be interpreted as being limiting. It is intended that the patent shall cover by suitable expression in the appended claims, whatever features of patentable novelty exist in the invention disclosed.

What is claimed is:

1. A door control mechanism for securing a door, swingable about an axis, in a closed position closing at least a portion of a door opening that is defined between opposed, spaced first and second door frame structures, wherein the door has a width that is configured to extend in a width direction between the spaced first and second door frame structures; with the door having a thickness that is defined by an inner skin, an outer skin and a space that extends therebetween to define a central cavity; with material providing a core that is interposed between at least selected portions of the inner and outer skins within said cavity to hold the first and second skins in spaced relationship; with the inner and outer skins being formed from substantially dimensionally stable material that is relatively thin in comparison with the thickness of the cavity space that extends between the inner and outer skins; with a selected one of the inner and outer skins having designated portions that extend in a common plane but are discontinuous in that the designated portions have opposed edge portions that extend substantially parallel to each other and substantially parallel to said width direction so as to define an elongate opening therebetween that extends substantially in said width direction, with the opening being in communication with the central cavity and opening through the selected one of the skins in a forward direction that is defined as extending away from said common plane and away from the central cavity; and, with the door control mechanism comprising:

a) elongate shaft means having first and second opposed end regions that are drivingly connected for concurrent movement by central region means configured to extend in said width direction at a location that overlies the opening, and for extending along at least a major portion of the length of the opening with the central region means defining substantially cylindrical formation means of substantially uniform diameter for extending coaxially along a common axis that substantially parallels the length of the opening at a substantially uniform distance from the opening as measured in said forward direction between said common axis and said common plane;

b) elongate structural member means having opposed side formation means for extending substantially adjacent to, and for being connected to said designated portions of the selected one of the inner and outer skins, having central portion means for extending between and connecting the opposed side formation means, and having a length that extends substantially the full length of the opening so as to substantially close the opening, and with the central portion means including central formation means for extending in said forward direction in at least one location that is situated between the opposed edge portions for defining concave surface portion means extending parallel to but spaced from said common axis at a location between said common axis and said common plane for opening toward said common axis to engagingly receive at least segments of said substantially cylindrical portions;

c) bearing bracket means connected to the elongate structural member means and extending into engagement with the elongate shaft means for causing at least said segments of said substantially cylindrical portions to be retained in pivotally movable engagement with the concave surface portion means for establishing a pivotal connection between the door and the elongate shaft means that permits relative movement therebetween about said common axis;

d) handle means for pivoting the elongate shaft means about said common axis between angularly related positions referred to as latching and unlatching positions;

e) first keeper means for being connected to the first of the two opposed door frame structures and defining a first receiving formation;

f) second keeper means for being connected to the second of the two opposed door frame structures and defining a second receiving formation;

g) first latch member means for being secured to the first end region of the elongate shaft means for rotation therewith about said common axis between said latching and unlatching positions, for being releasably engaged with the first receiving formation of the first keeper means when the swingable door moves to its closed position while said handle means has pivoted the elongate shaft means to said unlatching position, and for being movable into latching interengagement with the first receiving formation of the first keeper means when the handle means pivots the elongate shaft means from the unlatching position to the latching position while maintaining engagement between the first latch member means and the first keeper means; and, h) second latch member means for being secured to the second end region of the elongate shaft means for rotation therewith about said common axis between said latching and unlatching positions, for being releasably engaged with the second receiving formation of the second keeper means when the swingable door moves to its closed position while said handle means has pivoted the elongate shaft means to said unlatching position, and for being movable into latching interengagement with the second receiving formation of the second keeper means when the handle means pivots the elongate shaft means from the unlatching position to the latching position while maintaining engagement between the second latch member means and the second keeper means.

2. The door control mechanism of claim 1 additionally including handle retaining means for being connected to the door for releasably retaining the handle means in said latching position.

3. The door control mechanism of claim 1 wherein the first latch member means and the second latch member means each comprise cam means for cooperating respectively with the first keeper means and the second keeper means for assisting in moving the door to its fully closed position as the handle means pivots the elongate shaft means to position the handle means and the elongate shaft means in the latching position.

4. The door control mechanism of claim 1 wherein the central region of the elongate shaft means is of substantially constant diameter along its full length, with said constant diameter equaling that of said substantially uniform diameter.

5. The door control mechanism of claim 4 wherein the concave surface portion means that is defined by the central portion means of the elongate structural member extends along substantially the full length of the elongate structural member so as to receivingly engage and support the substantially constant diameter central region of the elongate shaft means along substantially the full length of the central region of the elongate shaft means.

6. The door control mechanism of claim 4 wherein the bearing bracket means includes a plurality of U-shaped bearing brackets that have opposed side mounting flange portions and central U-shaped formations that connect with the side mounting flange portions, and wherein the U-shaped formations cooperate with and overlie portions of the concave surface portion means so as to effectively surround parts of the substantially constant diameter central region at spaced locations along the length of the substantially constant diameter central region.

7. The door control mechanism of claim 6 additionally including fastener means for rigidly connecting the opposed side mounting flange portions to underlying portions of the elongate structural means.

8. The door control mechanism of claim 1 additionally including fastener means for rigidly connecting the opposed side formation means of the elongate structural member means to the designated portions of the selected one of the inner and outer skins.

9. A combined pivotally mountable door structure and door control mechanism for securing the door in a closed position closing at least a portion of a door opening that is defined between opposed, spaced first and second door frame structures, comprising:

a) a door that is pivotal about a hinge axis that is defined by a hinged connection of the door to a first of first and second spaced door frame structures that define at least a portion of a door opening that is closable by the door when the door is pivoted about the hinge axis to a closed position, wherein:

i) the door has a width that is configured to extend in a width direction between the spaced first and second door frame structures, and with the door having a thickness that is defined by an inner skin, an outer skin and a space that extends therebetween to define a central cavity;

ii) material providing a core is interposed between at least selected portions of the inner and outer skins within said cavity to hold the first and second skins in spaced relationship;

iii) the inner and outer skins are formed from substantially dimensionally stable material that is relatively thin in comparison with the thickness of the cavity space that extends between the inner and outer skins;

iv) a selected one of the inner and outer skins has designated portions that extend in a common plane but are discontinuous in that the designated portions have opposed edge portions that extend substantially parallel to each other and substantially parallel to said width direction so as to define an elongate opening therebetween that extends substantially in said width direction, with the opening being in communication with the central cavity and opening through the selected one of the skins in a forward direction that is defined as extending away from said common plane and away from the central cavity;

b) a door control mechanism includes:

i) elongate shaft means having first and second opposed end regions that are drivingly connected for concurrent movement by central region means configured to extend in said width direction at a location that overlies the opening, and for extending along at least a major portion of the length of the opening with the central region defining substantially cylindrical formation means of substantially uniform diameter for extending coaxially along a common axis that substantially parallels the length of the opening at a substantially uniform distance from the opening as measured in said forward direction between said common axis and said common plane;

ii) elongate structural member means having opposed side formation means for extending substantially adjacent to, and for being connected to said designated portions of the selected one of the inner and outer skins, having central portion means for extending between and connecting the opposed side formation means, and having a length that extends substantially the full length of the opening so as to substantially close the opening;

iii) the central portion means including central formation means for extending in said forward direction in at least one location that is situated between the opposed edge portions for defining concave surface portion means extending parallel to but spaced from said common axis at a location between said common axis and said common plane for opening toward said common axis to engagingly receive at least segments of said substantially cylindrical portions;

iv) bearing bracket means connected to the elongate structural member means and extending into engagement with the elongate shaft means for causing at least said segments of said substantially cylindrical portions to be retained in pivotally movable engagement with the concave surface portion means for establishing a pivotal connection between the door and the elongate shaft means that permits relative movement therebetween about said common axis;

v) handle means for pivoting the elongate shaft means about said common axis between angularly related positions referred to as latching and unlatching positions;

vi) first keeper means for being connected to the first of the two opposed door frame structures and defining a first receiving formation;

vii) second keeper means for being connected to the second of the two opposed door frame structures and defining a second receiving formation;

viii) first latch member means for being secured to the first end region of the elongate shaft means for rotation therewith about said common axis between said latching and unlatching positions, for being releasably engaged with the first receiving formation of the first keeper means when the swingable door moves to its closed position while said handle means has pivoted the elongate shaft means to said unlatching position, and for being movable into latching interengagement with the first receiving formation of the first keeper means when the handle means pivots the elongate shaft means from the unlatching position to the latching position while maintaining engagement between the first latch member means and the first keeper means; and, ix) second latch member means for being secured to the second end region of the elongate shaft means for rotation therewith about said common axis between said latching and unlatching positions, for being releasably engaged with the second receiving formation of the second keeper means when the swingable door moves to its closed position while said handle means has pivoted the elongate shaft means to said unlatching position, and for being movable into latching interengagement with the second receiving formation of the second keeper means when the handle means pivots the elongate shaft means from the unlatching position to the latching position while maintaining engagement between the second latch member means and the second keeper means.

10. The combined pivotally mountable door structure and door control mechanism of claim 9 additionally including handle retaining means for being connected to the door for releasably retaining the handle means in said latching position.

11. The combined pivotally mountable door structure and door control mechanism of claim 9 wherein the first latch member means and the second latch member means each comprise cam means for cooperating respectively with the first keeper means and the second keeper means for assisting in moving the door to its fully closed position as the handle means pivots the elongate shaft means to position the handle means and the elongate shaft means in the latching position.

12. The combined pivotally mountable door structure and door control mechanism of claim 9 wherein the central region of the elongate shaft means is of substantially constant diameter along its full length, with said constant diameter equaling that of said substantially uniform diameter.

13. The combined pivotally mountable door structure and door control mechanism of claim 12 wherein the concave surface portion means that is defined by the central portion means of the elongate structural member extends along substantially the full length of the elongate structural member so as to receivingly engage and support the substantially constant diameter central region of the elongate shaft means along substantially the full length of the central region of the elongate shaft means.

14. The combined pivotally mountable door structure and door control mechanism of claim 12 wherein the bearing bracket means includes plurality of U-shaped bearing brackets that have opposed side mounting flange portions and central U-shaped formations that connect with the side mounting flange portions, and wherein the U-shaped formations cooperate with and overlie portions of the concave surface portion means so as to effectively surround parts of the substantially constant diameter central region at spaced locations along the length of the substantially constant diameter central region.

15. The combined pivotally mountable door structure and door control mechanism of claim 14 additionally including fastener means for rigidly connecting the opposed side mounting flange portions to underlying portions of the elongate structural means.

16. The combined pivotally mountable door structure and door control mechanism of claim 9 additionally including fastener means for rigidly connecting the opposed side formation means of the elongate structural member means to the designated portions of the selected one of the inner and outer skins.

17. The combined pivotally mountable door structure and door control mechanism of claim 9 wherein the material providing a core includes a foamed substance.

18. The combined pivotally mountable door structure and door control mechanism of claim 9 wherein the material providing a core is adhered both to the inner skin and the outer skin at least at selected locations.

19. The combined pivotally mountable door structure and door control mechanism of claim 9 wherein the material providing a core includes core mean for connection with both of the inner and outer skins, and for holding the inner and outer skins in substantially parallel planes.

20. The combined pivotally mountable door structure and door control mechanism of claim 9 wherein the material from which the inner and outer skins is formed is metal.

21. The combined pivotally mountable door structure and door control mechanism of claim 20 wherein the metal from which at least one of the inner and outer skins is formed is aluminum sheet stock.

22. The combined pivotally mountable door structure and door control mechanism of claim 20 wherein the metal from which at least one of the inner and outer skins is formed is steel sheet stock.

23. The combined pivotally mountable door structure and door control mechanism of claim 9 wherein the door is a substantially rectangular structure, and the opening extends for a selected one of substantially the full length and substantially the full width of the rectangular door structure.

24. The combined pivotally mountable door structure and door control mechanism of claim 23 additionally including edge structure means of substantially [-shaped cross-section that perimetrically extends about and overlaps perimetrically extending portions of both of the inner and outer skins.

* * * * *